United States Patent [19]

Beezer et al.

[11] Patent Number: 4,881,356

[45] Date of Patent: Nov. 21, 1989

[54] APPARATUS FOR ASSEMBLING MULTI-PART ARTICLE

[75] Inventors: William E. Beezer; Earl F. Beezer, both of Mahwah, N.J.

[73] Assignee: Stelron Components, Mahwah, N.J.

[21] Appl. No.: 148,357

[22] Filed: Jan. 25, 1988

[51] Int. Cl.[4] ..... B65B 3/04; B65B 43/38; B65B 43/56; B65B 7/26

[52] U.S. Cl. ..... 53/53; 53/238; 53/239; 53/240; 53/377; 53/382; 53/383

[58] Field of Search ..... 53/53, 238, 239, 240, 53/377, 382, 383, 266 R

[56] References Cited

U.S. PATENT DOCUMENTS

| | | | |
|---|---|---|---|
| 2,922,519 | 1/1960 | Radley | 53/53 X |
| 3,444,982 | 5/1969 | Greiner | 53/238 X |
| 3,735,556 | 5/1973 | Dille et al. | 53/240 |
| 4,201,027 | 5/1980 | Ilsemann | 53/53 |
| 4,630,428 | 12/1986 | Lesch | 53/238 X |
| 4,672,797 | 6/1987 | Hagler | 53/377 X |
| 4,691,496 | 9/1987 | Anderson et al. | 53/53 |
| 4,790,116 | 12/1988 | Stridh | 53/377 X |

*Primary Examiner*—Horace M. Culver
*Attorney, Agent, or Firm*—Notaro & Michalos

[57] ABSTRACT

An assembling apparatus which is capable of assembling a multi-part article having a base with a plurality of receptacles for receiving components, such as make-up trays, and a lid hinged to the base, comprises an assembly chassis, having an endless rectangular guideway. A plurality of pucks are moveable from one accurately located station to another along the guideway. A transporting conveyor feeds a plurality of articles in an upside down condition to a labeling device which labels the bottom of each article. The articles are then flipped over to a right side up position and unloaded one at a time onto pucks of the endless guideway. The lid is mechanically opened and glue is deposited into each receptacle. Components are then loaded into each receptacle as are a brush or applicator and a dust cover. The lid is then closed and the articles are unloaded from the pucks. Sensors along the guideway sense whether each operation has been achieved successfully. A computer is connected to the sensors. The computer keeps track of the location of each puck as it moves from station to station along the guideway. If any sensor sends a signal to the computer indicating that an operation was unsuccessful, the computer thereafter labels that puck as containing an unacceptable article. The unloading device is then controlled to unload articles in a way that separates unacceptable articles from acceptable articles.

29 Claims, 12 Drawing Sheets

FIG. 20
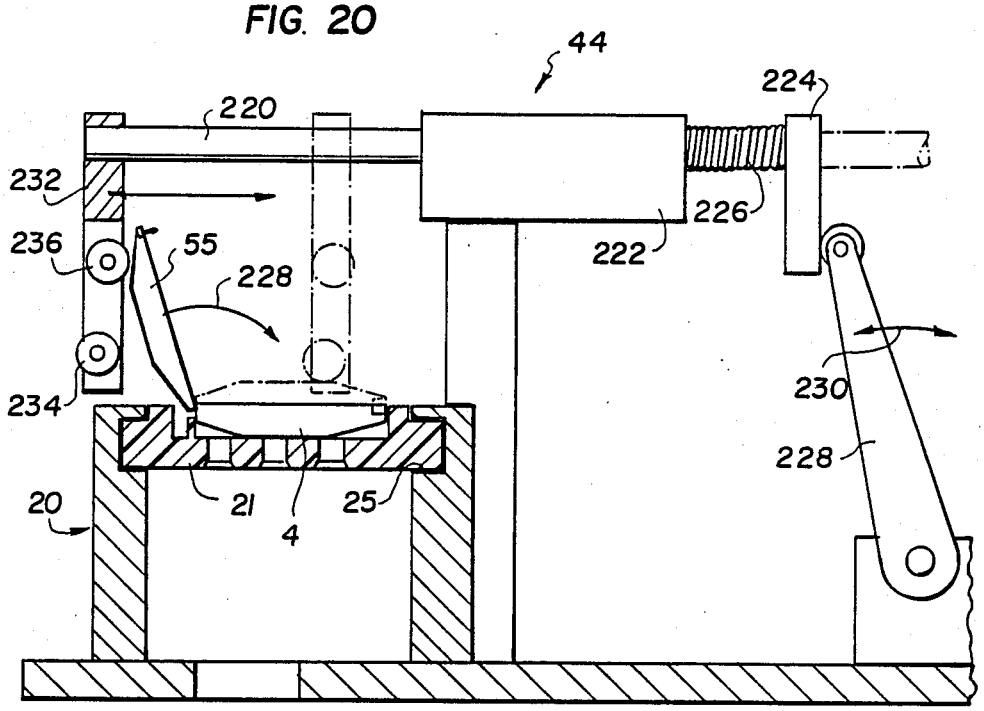
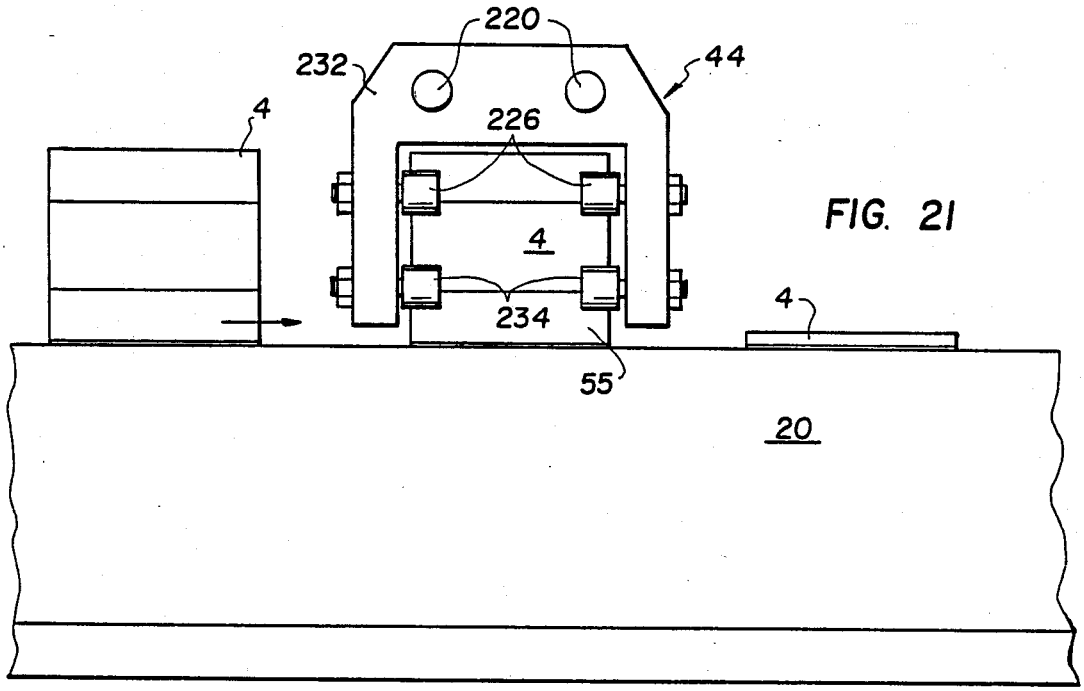
FIG. 21

APPARATUS FOR ASSEMBLING MULTI-PART ARTICLE

CROSS REFERENCE TO RELATED APPLICATION

The present invention utilizes an assembly machine chassis disclosed in an application entitled: ASSEMBLY MACHINE CHASSIS, filed, Apr. 9, 1987, and having Ser. No. 07/036,116, now U.S. Pat. No. 4,799,405 to one of the co-inventors, of the present application (William E. Beezer). That earlier application is incorporated here by reference.

The earlier application discloses an assembly chassis having an endless rectangular guideway which carries a plurality of pucks which are mounted for movement to a plurality of accurately located stations, in sequence around the guideway. The pucks are moved by walking beams under the guideway.

FIELD AND BACKGROUND OF THE INVENTION

The present invention relates in general to automated assembling machines, and, in particular, to a new and useful apparatus for assembling a multi-part article, in particular, a compact for make-up which has a base with at least one receptacle for receiving a component, such as a tray of make-up, and a lid hinged to the base for movement to a closed position covering the receptacle, to an open position exposing the receptacle.

Quality control is an important consideration for any manufacturing process. Some scheme must be established for distinguishing between acceptable manufactured articles and articles which have defects, and which are therefore unacceptable. This is a particularly difficult problem where one seeks to automate the manufacture of a multi-part article having components which are ultimately closed within an outer casing. Each casing must either be opened manually and visually inspected, or else some other mechanism must be found for verifying the correct manufacture of the article. Re-opening the casing after it has been closed in an automated assembly line is particularly wasteful of time and manpower. A manufacturing apparatus which can automatically distinguish between acceptable and unacceptable articles would thus be particularly useful.

The apparatus of the present invention has this capability. By sensing the condition of the article at strategic locations along the assembly line, and by keeping track of the position of each article on the assembly line, the apparatus can distinguish between acceptable and unaccpetable articles and separate these articles accordingly.

The present invention requires actuators that are capable of moving articles and components extremely accurately. Actuators which can be used in the present invention have been disclosed in three U.S. patents to one of the co-inventors (Earl F. Beezer). U.S. Pat. No. 3,703,834 entitled DEVICE FOR TRANSMITTING CONTROL TRANSLATORY MOVEMENTS, discloses an actuator which is driven by a rotary shaft to transmit this rotary movement into accurate movement in an X and Y direction. U.S. Pat. No. 3,869,924 entitled DEVICE FOR TRANSMITTING ACCURATE TRANSLATIONAL AND ROTARY MOVEMENTS, discloses an actuator which is capable of accurately rotating a shaft about its own axis and translating the shaft along its axis. U.S. Pat. No. 3,881,362 entitled ADJUSTABLE X AND Y AXIS CONTROLLED MOVEMENT MECHANISM, is another actuator which is capable of accurate movement in X and Y directions. These three patents, which have all been issued to Earl F. Beezer, are incorporated here by reference.

SUMMARY OF THE INVENTION

The present invention relates to an apparatus or system for assembling a multi-part article which has a base with at least one receptacle or pan for receiving a component, such as a tray, and a lid hinged to the base for movement from a closed position, covering the receptacle to an open position exposing the receptacle. The apparatus includes an assembly chassis having an endless guideway. A plurality of pucks are mounted for movement on the guideway to a plurality of accurately located stations in sequence around the guideway. Each puck has a site for receiving the base of one of the articles to be assembled. Puck drive means are provided for indexing each puck from one station to the next around the guideway. Transport means are also provided for bringing a plurality of articles to the chassis for assembly. An article loader loads the base of each article onto a separate puck at a loading station on the guideway. Each base is already provided with a lid when it is transported to the chassis. Lid opening means; which are positioned downstream of the article loader along the guideway; open the lid of each article at an opening station. Glue depositing means, positioned downstream of the lid opening means, deposit glue into all receptacles of each article at a gluing station on the guideway. Sensor means, downstream of the glue depositing means, along the guideway, sense whether glue has been successfully deposited into the receptacles or not. Computing means are also provided for keeping track of each puck as it moves from station to station around the guideway. The computing means are connected to the sensor means for determining the condition of the article in each puck, specifically whether the article has been subjected to a successful deposition of glue. A component loader which is downstream of the glue depositing means loads a component into each receptacle. The computing means is connected to the component loader for disabling the component loader from loading any component onto the base of an article which has had an unsuccessful deposition of glue into any of its receptacles. Such an article has already been categorized as unacceptable by the computing means. By disabling the component loader for such an article, components are saved from being loaded into unacceptable articles.

Lid closing means are provided downstream of the component loader for closing the lids of the articles. An article unloader downstream of the lid closing means loads acceptable articles onto an acceptable article path and unacceptable articles onto an unaccpetable article path. The computing means is connected to the article unloader for enabling the article unloader to distinguish between the acceptable and the unacceptable articles.

In a further development of the invention, a brush or applicator loading device is provided along the guideway for loading a brush or an applicator into the base of each article. The computing means is likewise connected to the brush or applicator loading device for disabling the device from loading a brush or applicator into an unacceptable article base. A dust cover loading device may also be provided for loading a dust cover over the components which have been glued into the receptacles of the article. Additional sensors are also advantageously provided to ensure that components have been successfully loaded, that brushes or applicators have been successfully loaded and, that the dust covers have been successfully loaded. If any of these operations are unsuccessful, the computing means identifies that article as being unacceptable for all subsequent operations. This classification is maintained at least until the article is unloaded by the article unloader means to ensure that acceptable articles are separated from unacceptable articles.

To permit the application of the label to the bottom of each article base, the transport means supplies the article bases with lids, in an upside down condition, to a conveyor. The conveyor extends under a labeling device for labeling the bottom of each article base. A flip over device is provided downstream of the labeling device for turning each article over into a lid up position after the labeling operation and before the article is to be loaded onto the endless guideway.

According to the invention, a multi-part article can be assembled in an automated manner, with the quality of acceptable articles being ensured.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the accompanying drawings, forming a part of this specification, and in which reference numerals shown in the drawings designate like or corresponding parts throughout the same:

FIG. 20 is a side sectional view of a lid closing device for closing the lid of articles being manufactured;

FIG. 21 is a front elevational view of the device in FIG. 20; and

DESCRIPTION OF THE PREFERRED EMBODIMENT

Figure 1:
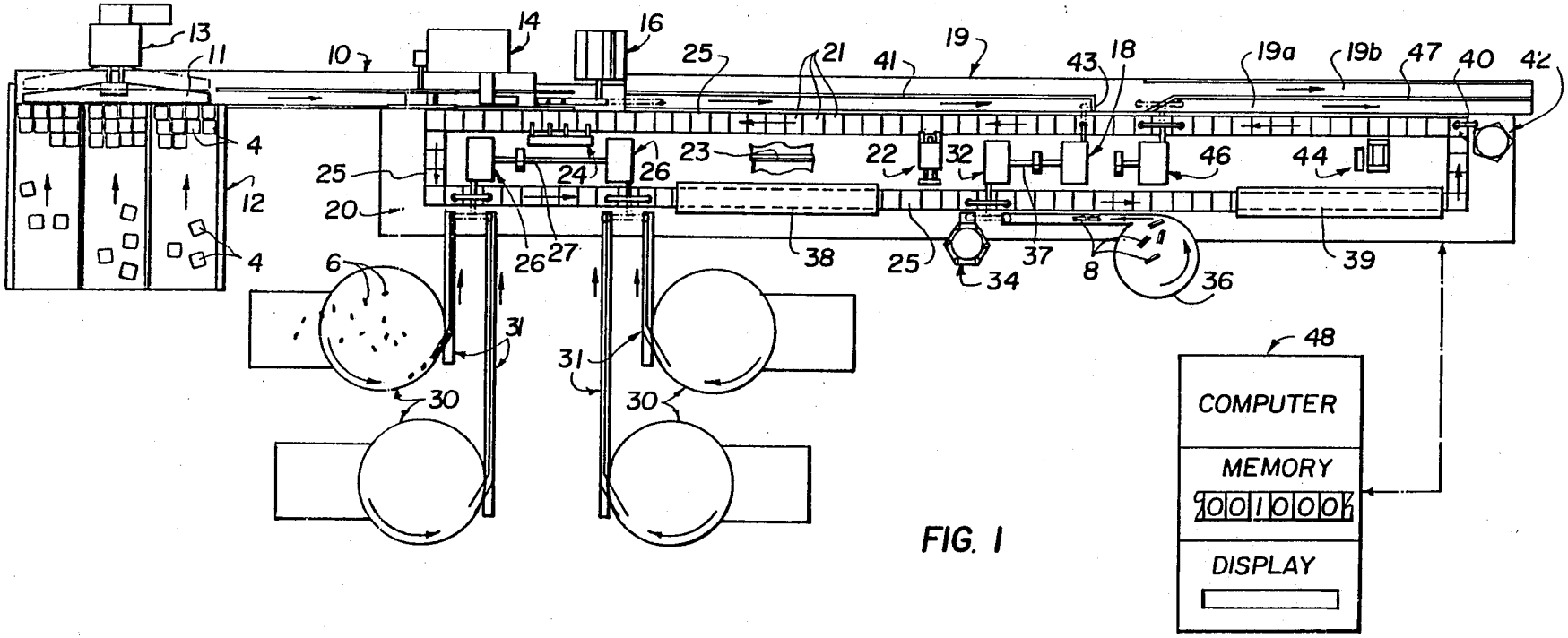
FIG. 1 is a top plan view of the apparatus for assembling an article in accordance with the present invention.
Figure 2:
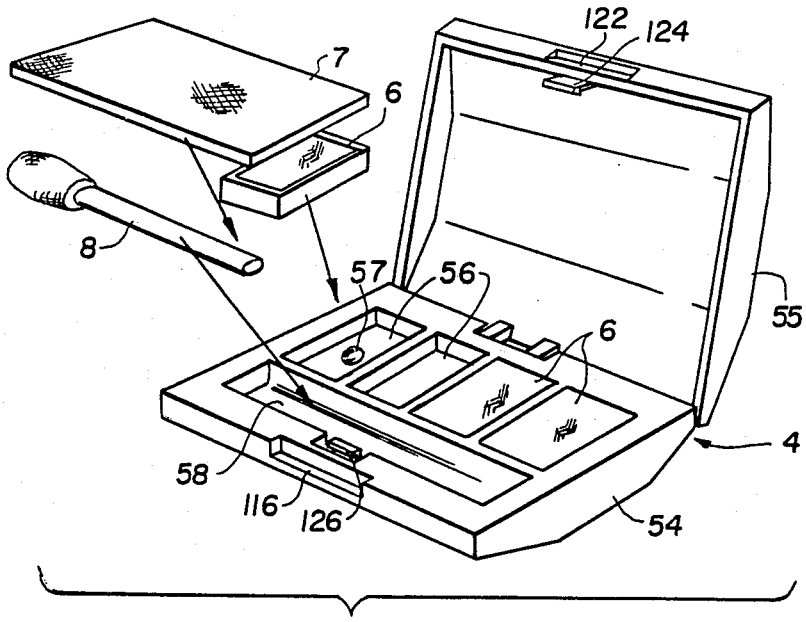
FIG. 2 is an exploded perspective view of a multi-part article to be assembled by the apparatus of the present invention, in particular, a compact for make-up.

Referring to FIG. 1, the invention embodied therein comprises an apparatus or system for assembling a multi-part article 4 The articles, which, in the illustrated embodiment comprise make-up compacts, shown in FIG. 2, are manually deposited onto an infeed conveyor 12, in an upside down condition. Infeed conveyor 12 moves in the direction of the arrows toward a dead plate 11 which is driven by dead plate driver 13 from the solid line position to a phantom line position shown in FIG. 1. In the solid position, a row of articles 4 are aligned along the dead plate 11. The conveyor 12 slides under these now detained articles. When the dead plate 11 moves to its phantom line position, a distance which is substantially equal to the width of the articles, the articles drop onto a transporting conveyor 10 which moves to the right in FIG. 1 in the direction of the arrow on conveyor 10. Conveyor 10 moves under a commercially available labeling machine 14 which applies a label individually to the bottom of each article 4. It is recalled that at this point, each article is in an upside down position.

A flip over device 16 at the end of transporting conveyor 10 flips two articles at a time over onto a second transporting conveyor 19. The articles proceed to the right in the direction of the arrows on conveyor 19 along a rail 41 to a stop 43. A row of articles is maintained on conveyor 19 upstream of stop 43. Conveyor 19 slides under this row of articles. An article loader 18 which can move in an X, Y direction, individually loads one article at a time into each puck 21 of an assembly chassis 20. As disclosed in the above-identified application to William E. Beezer, assembly chassis 20 comprises an endless guideway 25 and drive means which accurately index each puck from station to station around the guideway. The drive means are schematically shown as a main drive shaft 23, which is positioned below the guideway 25. Arrows on the guideway 25 show the direction of indexed movement of the pucks.

A lid opening device 22 is positioned downstream of the article loading device 18 and functions to open the lid of each article. The articles are then supplied in sequence along guideway 25 to glue depositing means 24. After the deposition of glue into receptacles in the now open article, the articles are further conveyed past one or more component loading devices 26 which are supplied by component conveyors 30 and 31 with components to be deposited into the article being manufactured. An ultraviolet sterilizer 38 may be provided downstream of the component loading devices for sterilizing the components. As will be discussed in connection with FIG. 2, the components may be make-up containing trays, which are deposited into receptacles of the article.

A brush magazine 34 is provided downstream of the sterilizer 38. This magazine supplies brushes, one at a time, which are loaded by a brush loading device 32, onto an article being manufactured. Alternatively, an applicator conveyor 36 can provide applicators 8 to the same brush loading device 32 for loading the applicators onto an article being manufactured. For the purpose of this disclosure, the term applicator will be used to designate either a brush or an applicator.

Optionally, a further ultraviolet light sterilizer 39 is provided downstream of the brush or applicator loading area.

Further along on the guideway 25, the articles are provided with a dust cover.

A dust cover magazine 42 carries a supply of dust covers which are loaded, one at a time, by dust cover loader 40, onto articles being manufactured. Downstream of this location, on the guideway 25, a lid closing device 44 is provided for closing the lid of each article. Further downstream on the guideway, an article unloading device 46 is provided, which unloads articles which have been judged to be acceptable by a computer 48, onto an acceptable article pathway 19*a*, which is on one side of a rail 47, at the downstream end of second transporting conveyor 19, or onto an unacceptable article pathway 19*b* on an opposite side of rail 47. The acceptable articles are then discharged for assembly and packing while the unacceptable articles are discharged for waste or for recycling their components or materials.

As also shown in FIG. 1, computer 48 includes a memory and a display. The memory contains a program for operating some aspects of the various devices used in the apparatus. The memory also includes a shift register or other appropriate mechanism for containing at least one data indication for each puck 21 as it moves from station to station around the guideway 25 and for keeping track of the position of each puck on the guideway. Each address location in the shift register corresponds to one puck. With each indexing of pucks on the guideway, the register is shifted once. The data entry for each puck thus shifts and the computer can always keep track of all pucks at all stations. The data indication may, for example, be a logical "0" to indicate that the puck carries an acceptable article, or a logical "1" to indicate that the puck carries an unacceptable article. Sensors are provided after each manipulating step along the apparatus to insure that the step has been successfully completed. The sensors are connected to the computer 48. If any sensor indicates that an operation has been unsuccessful, the data entry for that puck is changed from an "0" to a "1". All future operations involving the installation of a new component for that puck are thereafter suspended by the computer. For example, if a sensor downstream of the glue depositing means 24 senses that the glue has not been successfully deposited into a receptacle of the article, the data entry for the puck carrying that article is switched from an "0" to a "1". The component loading devices 26, the brush or applicator loading device 32 and the dust cover loading device 40 is then disabled by the computer when that puck reaches the respective station to avoid wasting components on the unacceptable article. Ultimately, the computer controls the article unloading device 46 to unload that article onto the unacceptable article 19*b*. Conversely, all articles which maintain an acceptable data entry are loaded onto the acceptable article pathway 19*a* upon reaching the article loading device 46.

In accordance with the preferred embodiment of the invention, disabling of the loading devices and controlling of the article unloading device 46 are achieved by opening or closing pneumatic valves which enable or disable suction heads in the various devices. This will be explained in greater detail later in this disclosure.

Referring to FIG. 2, the multi-part article which can be assembled in accordance with the present invention is a compact 4, having a base 54. A lid 55 is hinged to the base 54 for movement from an open position shown in FIG. 2 to a closed position covering the base. The base contains a plurality of receptacles 56 each for receiving a component of the article, such as a make-up containing tray 6. To fix the trays in the receptacles, each receptacle receives a deposit of glue 57. A further receptacle or indentation 58 is provided for receiving an applicator 8 or a brush (shown at 9, in FIG. 16).

A dust cover 7 is placed over the trays 6 and the lid 55 is closed to complete assembly of the article.

Figure 3:
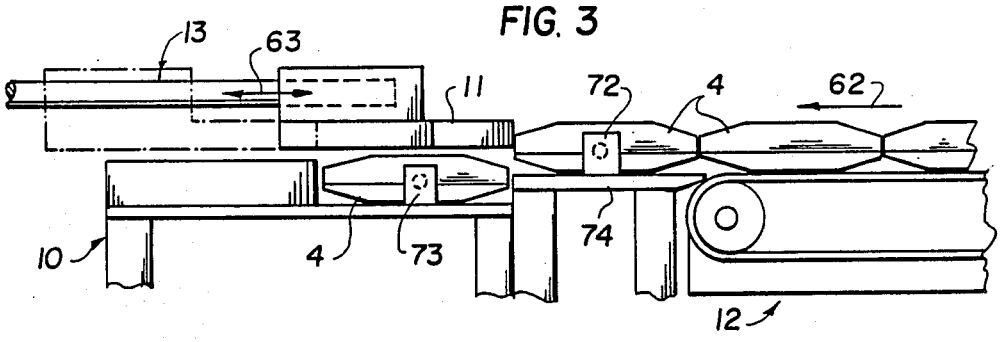
FIG. 3 is a fragmentary side elevational view of an infeed conveyor and dead plate device for supplying articles to a transporting conveyor.

FIG. 3 shows infeed conveyor 12 which urges several rows of articles 4 in the direction of arrow 62. The first row of articles 4 is urged against a dead plate 11, which can reciprocate in the direction of arrow 63 by a dead plate driver 13. The actuator of U.S. Pat. Nos. 3,703,834 or 3,881,362 may be used to move driver 13. When reciprocated to the left in FIG. 3, the first row of articles drops down onto first transporting conveyor 10 for movement perpendicularly to the plane of FIG. 3. A sensor 72 is provided at one end of a step 74 which is at the level of the upper run of conveyor 12 and above the level of conveyor 10. Sensor 72 is connected to computer 48 for indicating to the computer that at least one row of articles is available. If no articles are sensed by sensor 72, computer 48 stops the operation of driver 13 and signals on its display that attention is needed. Likewise, a sensor 73 is provided at one end of conveyor 10 to ensure that at least some articles 4 have dropped onto the conveyor 10.

Figure 4:
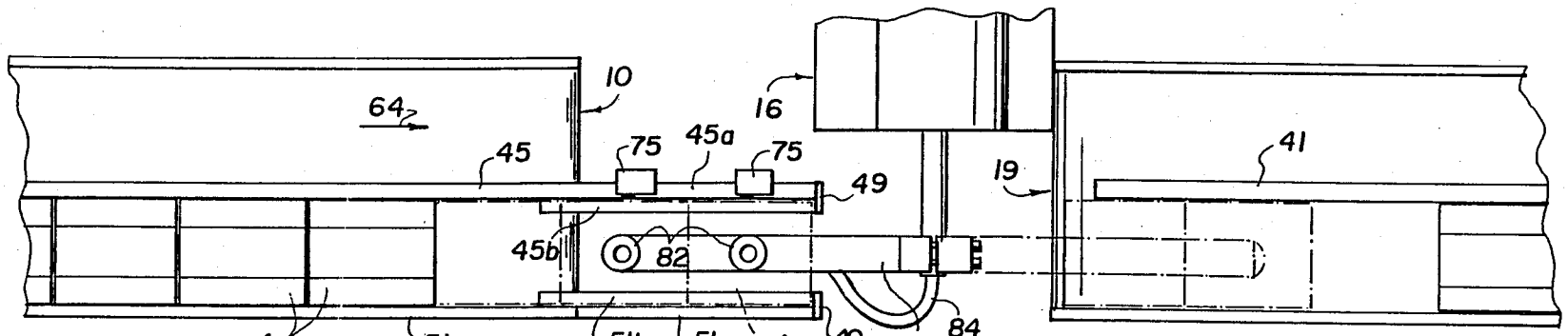
FIG. 4 is a fragmentary top plan view of a flip over device for flipping the articles from an upside down condition to a right side up condition.
Figure 5:
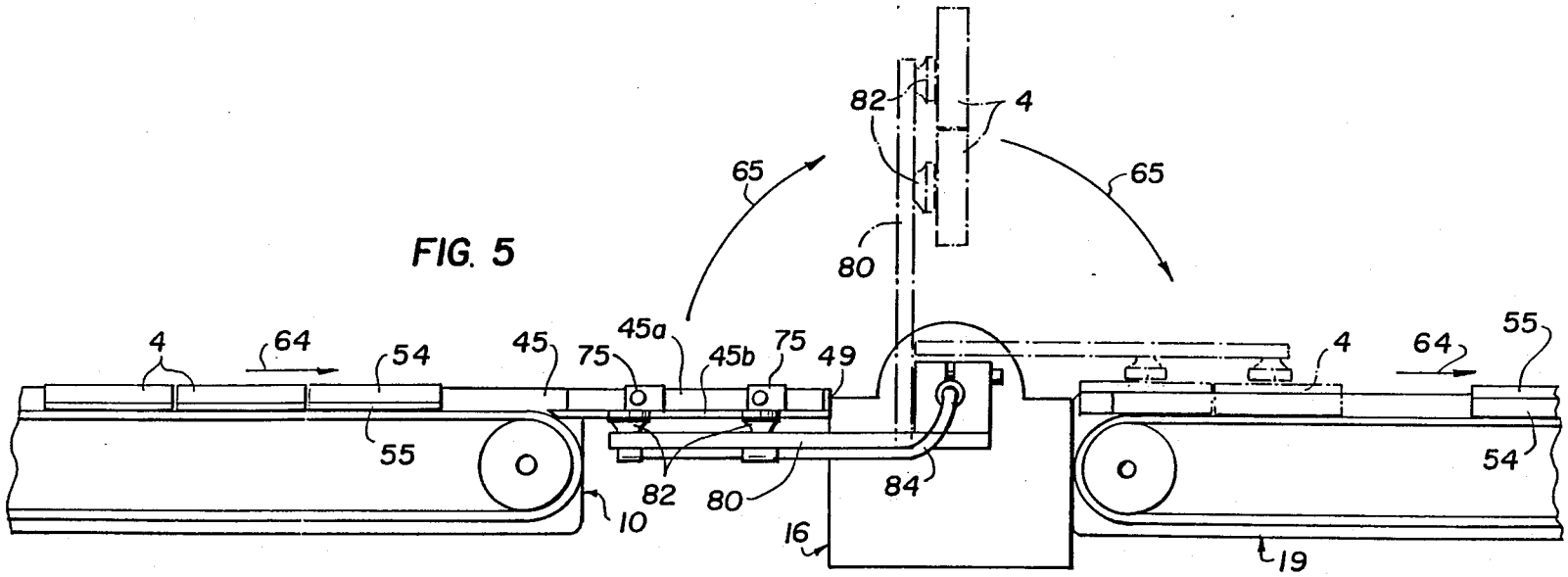
FIG. 5 is a side elevational view of FIG. 4.

Turning now to FIGS. 4 and 5, a rail 45 is provided over the downstream end of conveyor 10 for confining the articles 4 to one side of the conveyor, which is bounded by a further rail 51. The continued movement of conveyor 10 in the direction of arrow 64 moves the row of articles 4 onto extensions 45*a* and 51*a* of rails 45 and 51, which extend out beyond the end of conveyor 10. These extensions carry lower flanges 45*b* and 51*b*. A pair of articles 4 are moved out onto the extensions and bridge the flanges. Their movement in the direction of arrow 64 is stopped by stops 49. In this position, a pivot arm 80 of flip over device 16 is pivoted up under the articles on extensions 45*a* and 51*a*.

Arm 80 carries a pair of suction heads 82 through which a partial vacuum is drawn by a tube 84 to suctionally engage the downwardly facing lids 55 of the articles 4. FIG. 5 shows in phantom line, the intermediate and final positions of the articles 4, as they move along the curved path 65. In this way, two articles at a time are deposited onto second transporting conveyor 19 for continuing their movement in the direction of arrow 64.

U.S. Pat. No. 3,869,924 discloses an actuator which can be used as the flip over device 16.

Sensors 75 are provided on rail extension 45*a* to ensure that articles are available on the extensions so that they can be flipped over.

Articles 4 thus continue their travel on conveyor 19 in a right side up condition.

Figure 6:
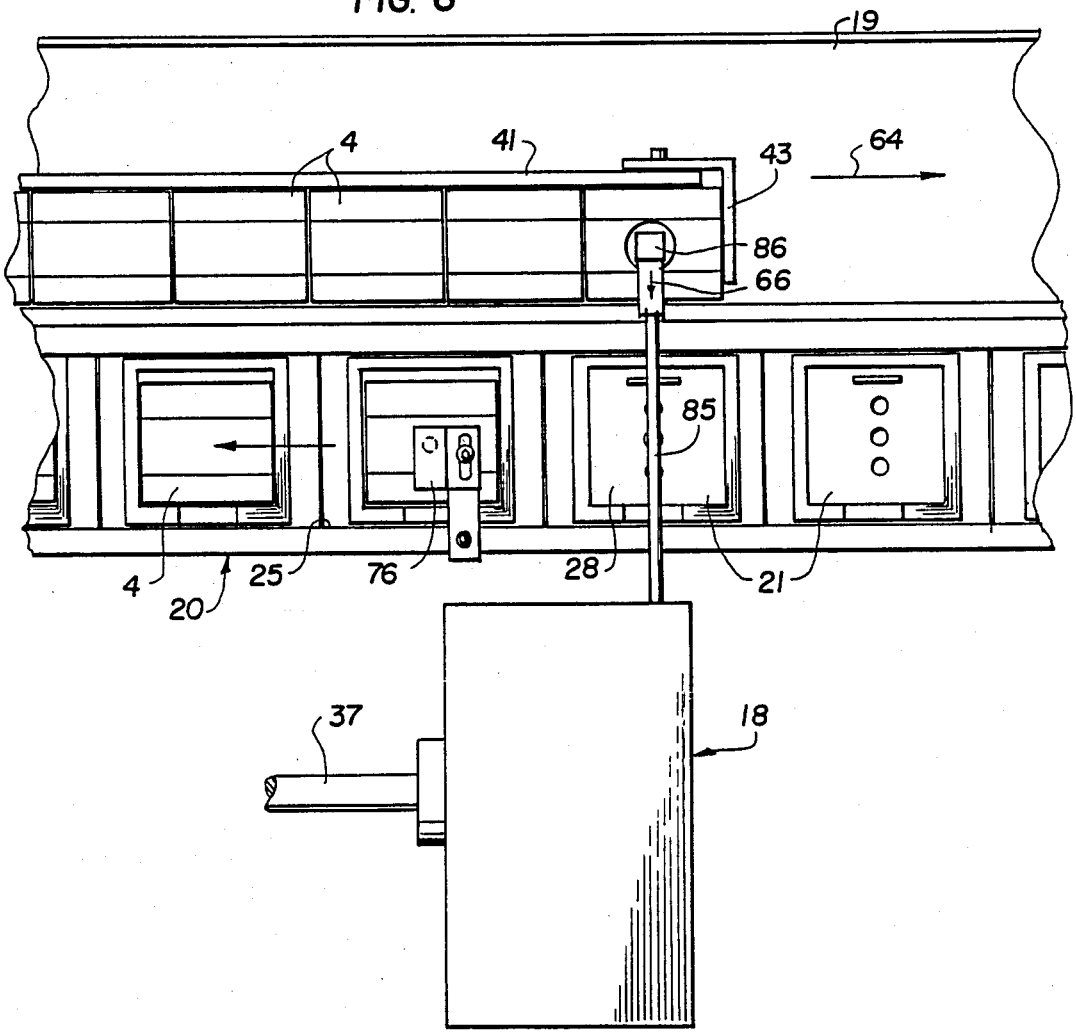
FIG. 6 is a top plan view of an article loading device for loading the right side up articles onto an assembly chassis.

FIG. 6 illustrates the article loading device 18, which can be formed by the actuator of U.S. Pat. No. 3,881,362. The articles 4 in their right side up condition move along conveyor 19 on one side of rail 41. Their motion in the direction of arrow 64 is stopped by stop 43 at the end of rail 41. At this location, a suction head 86 on an arm 85 of loading device 18 suctionally engages the lid of the upstream most article 4. Arm 85 of loading device 18 then moves upwardly perpendicular to the plane of FIG. 6 and then in the direction of arrow 66 over the guideway 25 of assembly chassis 20. A puck 21 is accurately positioned at a loading station immediately below arm 85 so that the article 4 engaged by suction head 86 is deposited into a receiving site 28 of the puck 21. A sensor 76 immediately above the subsequent station along guideway 25 determines whether, in fact, the loading operation is acceptable. If not, the puck below sensor 76 is identified as an unacceptable article location (in fact, there may be no article present at all). All subsequent operations will thus be suspended for this puck as it moves to the subsequent operating stations.

Figure 7:
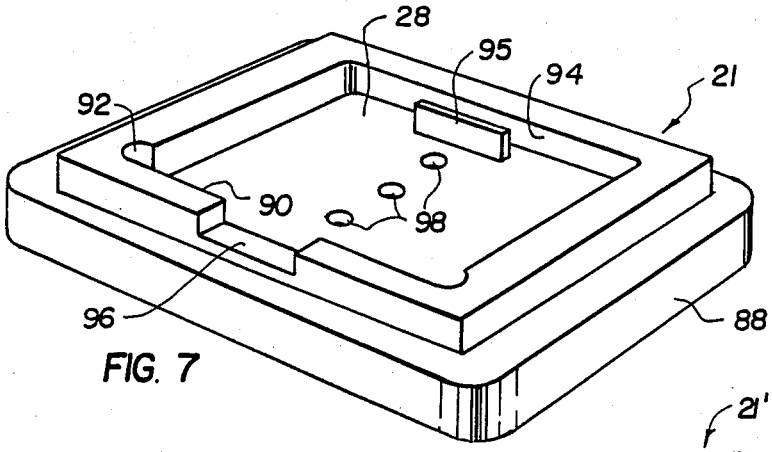
FIG. 7 is a perspective view of a puck used in the assembly chassis.
Figure 8:
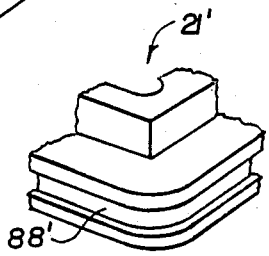
FIG. 8 is a fragmentary perspective view of another embodiment for the puck.

Each puck 21, as shown in FIG. 7, has a lower portion 88, which is shaped to ride within the guideway 25 of the assembly chassis 20. As described in the application entitled ASSEMBLY MACHINE CHASSIS, which was identified above, a plurality of these pucks ride in the rectangular guideway and are accurately positioned from station to station by walking beams. The sides of the lower portion 88 rides smoothly against the sides of the guideway 25. The sides are flat as shown in FIG. 7. An alternate embodiment of the puck is shown in FIG. 8 which shows a lower portion 88', having sides with upper and lower flanges. Since the pucks are very closely positioned one next to the other, it has been found that in situations where expansion and contraction may be a problem, flanges prevent jamming of the pucks as they move in the guideway.

Returning to FIG. 7, each puck 21 has a site 28 in the form of an indentation for receiving a compact or article base. The front wall of the compact base can be engaged closely against the wall 90 of the puck site by providing cut outs 92 at the otherwise rounded corners of the site. The rear of the compact base is spaced away from the rear wall 94 of the site 28 and is held against the front wall by a tab 95 which projects upwardly from the floor of the site 28. By spacing the rear wall of the compact base away from the rear wall of the site 28, the lid 55 of the compact base 54 can be swung between its open and closed positions without interference.

The front wall 90 of puck site 28 also includes a recess 96 which provides access to the compact 4 for the purpose of opening the lid of the compact as will be described later. Holes 98 in the floor of the site 28 are provided for the pins of walking and locking beams used to move and accurately position the pucks. The function of these holes is disclosed in greater detail in the application identified above and incorporated here by reference.

Figure 9:
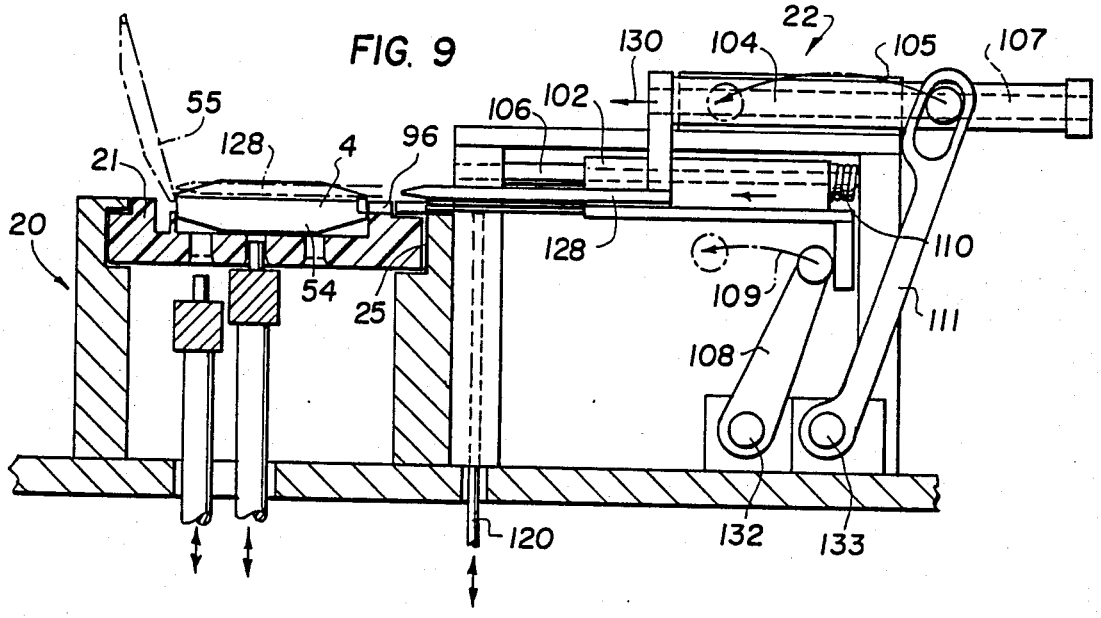
FIG. 9 is a side elevational view, partly in section of a lid opening device.
Figure 10:
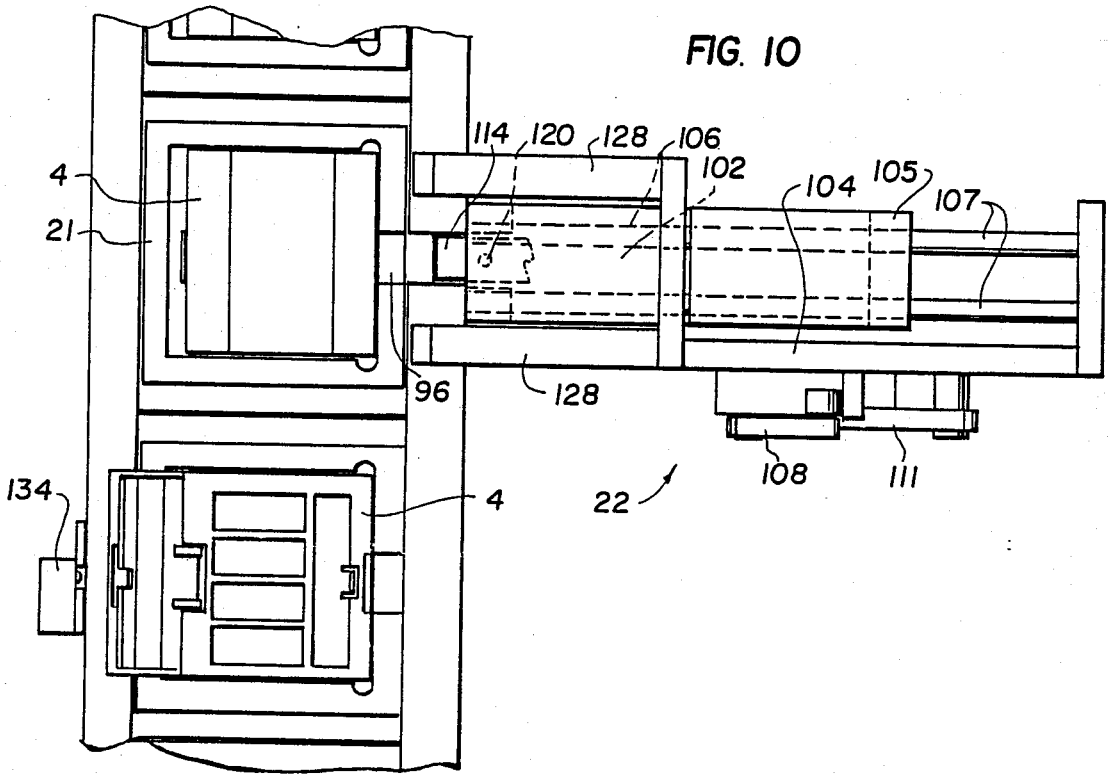
FIG. 10 is a top plan view of FIG. 9.
Figure 11:
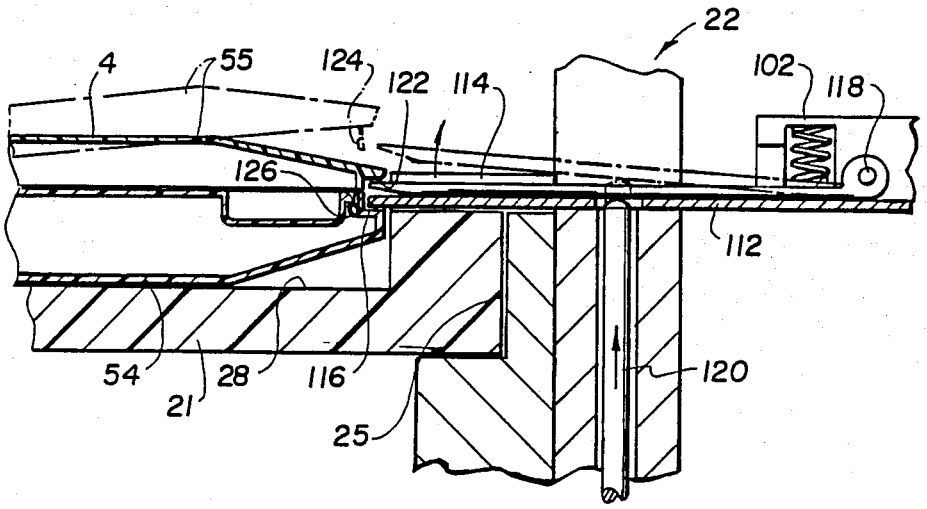
FIG. 11 is a fragmentary side sectional view, on an enlarged scale of the lid opening device.

FIGS. 9, 10 and 11 illustrate the lid opening device 22. The opening device comprises a first slide 102, which rides by linear bearings on shafts 106 fixed to chassis 20 for movement toward and away from the guideway 25. This movement is controlled by a crank 108, which pivots in the direction of the broken arrow 109 to permit slide 102 to move toward the guideway 25 by virtue of a spring 110. Crank 108 pivots in an opposite clockwise direction to retract the slide 102 away from the guideway 25. Power for rotating this and other cranks and actuators described in this application can be tapped from the main shaft of the chassis drive or from any other suitable mechanism, such as an independent motor.

As best shown in FIG. 11, slide 102 carries a lower hold down finger 112, which is fixed to the slide. When slide 102 is moved toward the guideway 25, the tip of finger 112 slides through the recess 96 of a puck 21 at an opening station immediately adjacent the opening device. The tip of finger 112 then engages over a step 116 of the base 54 of compact or article 4. This serves to hold the front end of the compact down in its site 28.

In this position, an upper unlatching finger 114, which is pivotally mounted to slide 102 at pivot connection 118, is lifted by a lifting rod 120 to move to the phantom line position shown in FIG. 11. This lifts an upper step 122 under the front end of lid 55. This action serves to unlatch a snap latch projection 124 which extends downwardly from the lid 55 from a snap latch recess 126 defined in the base 54.

With the lid thus unlatched from the base, opening fingers 128 which are fixed to a second slide 104, move in the direction of arrow 130 shown in FIG. 9, toward the guideway, over the top of the base 54 and under the lid 55, to move the lid to its fully open position shown in phantom line in FIG. 9. The second slide 104 is driven by a second crank 111. Slide 104 carries shafts 107 which ride in a linear bearing 105, that is fixed to the chassis.

By using a pair of widely spaced opening fingers 128, a secure opening of the lid is achieved without stressing the hinge of the compact.

Cranks 108 and 111 are pivotally connected to the chassis at respective pivot connections 132 and 133.

A sensor 134 connected to the computer 48 is positioned above guideway 25 at a station downstream of the opening station to ensure that each lid has been successfully opened. Here, again, if the sensor senses that a lid has not been opened, the computer marks this site as containing an unacceptable article.

Figure 12:
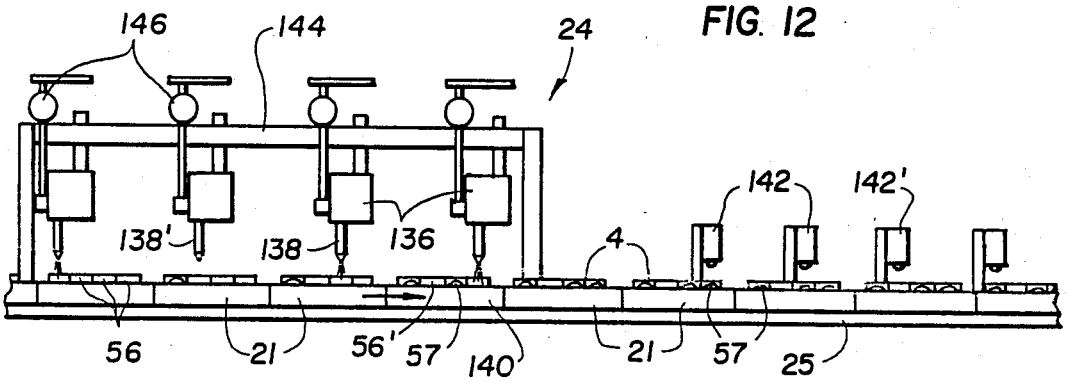
FIG. 12 is a side elevational view of glue dispensers for dispensing glue into receptacles of the articles to be manufactured.

Turning now to FIG. 12, the glue depositor 24 has a glue depositing head 136 for each receptacle of the compact 4. Each glue dispensing head has a nozzle 138 positioned immediately over a respective one of the receptacles at a gluing station immediately below that nozzle. As an individual article or compact 4 moves from station to station, among the four gluing stations below each of the nozzles 138, it receives a deposit of glue for one of its receptacles. In this way, at the last gluing station 140, all four receptacles 56 should have a deposit of glue 57.

Four sensors 142, 142' are also provided for ensuring that each receptacle has received glue. In the example shown in FIG. 12, one receptacle marked 56' has not received glue because of the failure of a nozzle 138' to successfully deposit the glue. The sensor under that receptacle shown at 142' senses the lack of glue in that receptacle and thus marks this puck as containing a unacceptable article for all future operations.

The apparatus of the present invention is easily adapted for different types of articles having a different number and different configuration of receptacles. If, for example, three receptacles are provided rather than four, the glue depositing heads 136 can be moved on a support rail 144 until their nozzles are brought to the correct location for each gluing station. Since only three heads are needed for this type of article, a manually operated valve 146 can be closed for one of the four heads. Alternatively, one of the heads can simply be removed from rail 144. In likewise fashion, the position of each of the sensors 142 can be moved back and forth to the correct location on the guideway 25 so that it is immediately over the receptacle which it is meant to sense.

Figure 13:
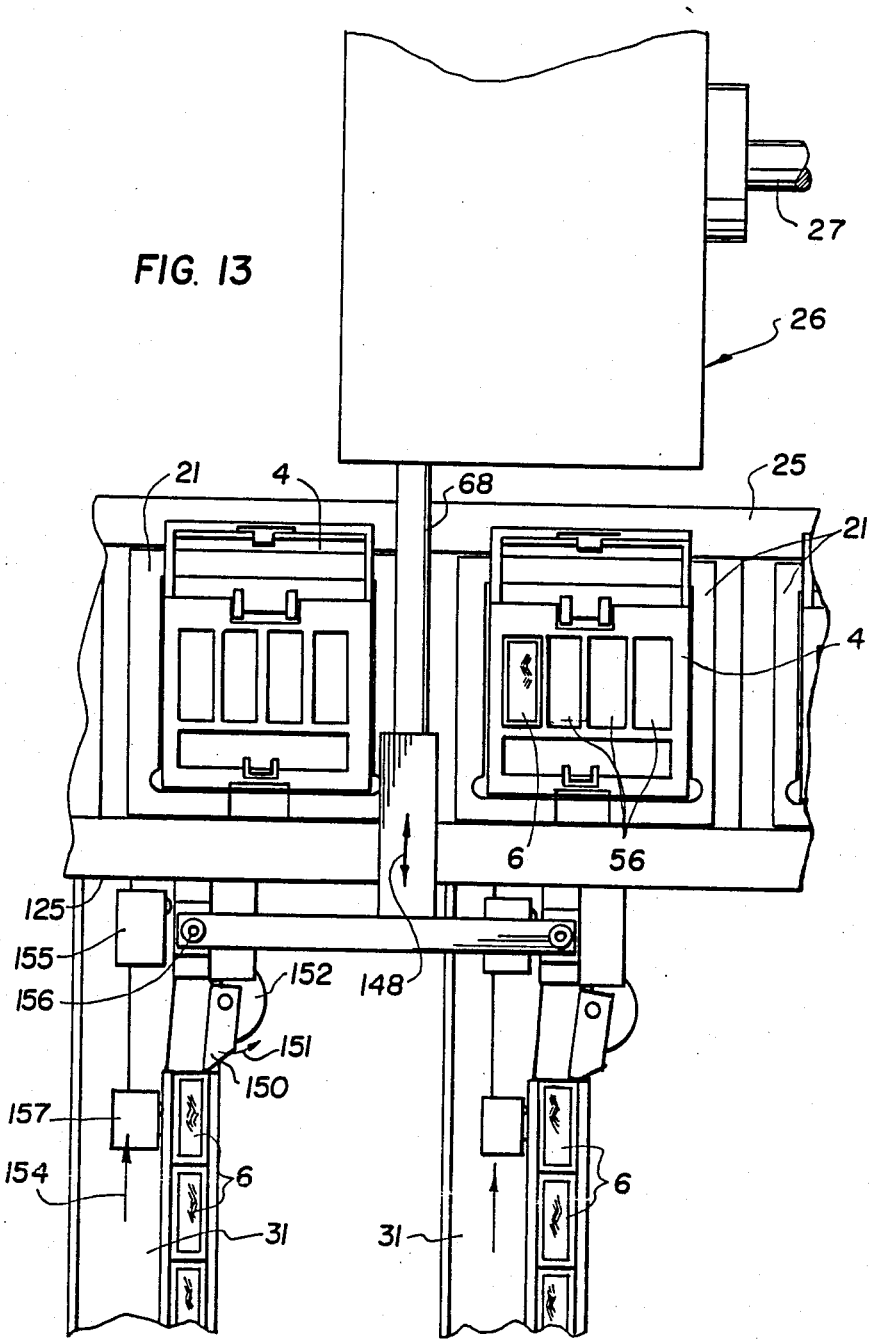
FIG. 13 is a fragmentary top plan view of a component loading device for loading components into the receptacles of the articles.

FIG. 13 shows details of one of the tray loader 26. Tray loader 26 can be the actuator disclosed in U.S. Pat. No. 3,881,362. This actuator has an arm 68 which can be moved in a horizontal direction shown by double arrow 148, and in a vertical direction as well. The actuator is driven by shaft 27 which can receive power through a pulley from the main shaft 23.

Figure 14:
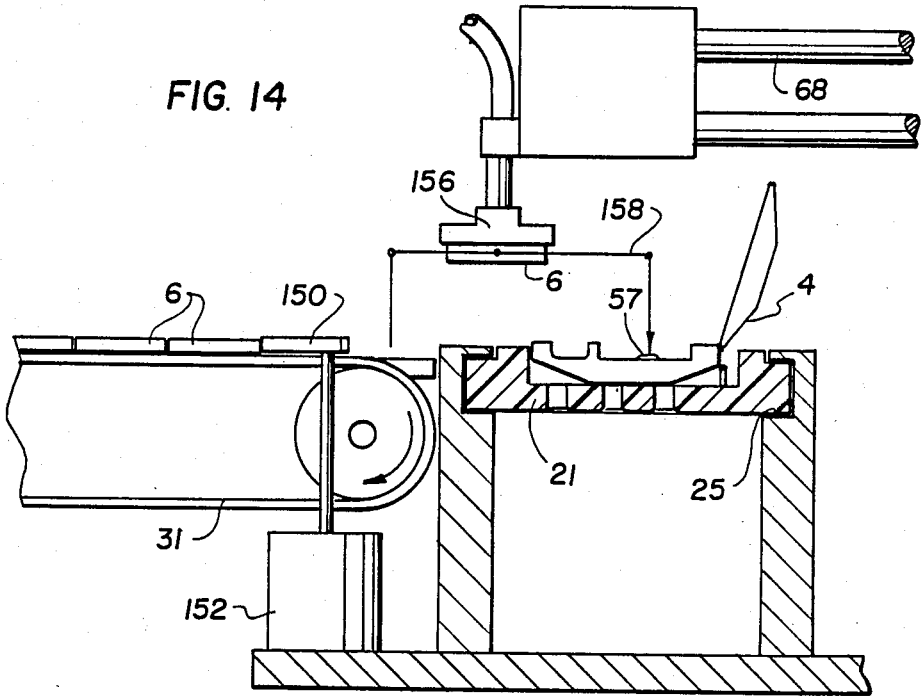
FIG. 14 is a fragmentary side sectional view of FIG. 13.

Components or trays 6 are provided by a conveyor 31 which moves a row of these trays toward a pivot stop 150. As shown at FIG. 14, pivot stop 50 can be driven by a stepping motor 152. With a row of trays 6 engaged against the pivot stop 150, a conveyor belt of conveyor 31 simply slides under the row of trays.

When a compact 4 has been brought to a first component loading station, shown at the left in FIG. 13, motor 152 is activated to rotate pivot stop 150 momentarily in the direction of arrow 151 to allow the forward most tray 6 to move in the direction of arrow 154. Stop 150 is immediately pivoted back to its initial position to retain all subsequent trays. By virtue of conveyor 31, the first tray is brought up against the side 125 of guideway 25. At this position, a suction head 156 carried by arm 68 is moved down onto the tray 6. The motion of arm 68 follows the path 158 shown in FIG. 14 to deposit the tray into its receptacle and onto the glue which had previously been provided in that receptacle. The compact, on its puck, is then indexed to the next component loading station shown at the right in FIG. 13. FIG. 13 shows the first compact 6 already in the first compartment, awaiting loading of the second compact into the second compartment. Loading of the second tray or component is achieved in the same way as the first.

For any compact or article that had been categorized as unacceptable by the computer, vacuum to the suction head is suppressed by closing a valve so that no component is loaded for that article. For example, if the computer received a signal that one of the receptacles had not received a deposit of glue, no trays are loaded into any receptacles of that article. This saves trays from being installed into compacts which will ultimately be discarded.

Figure 15:
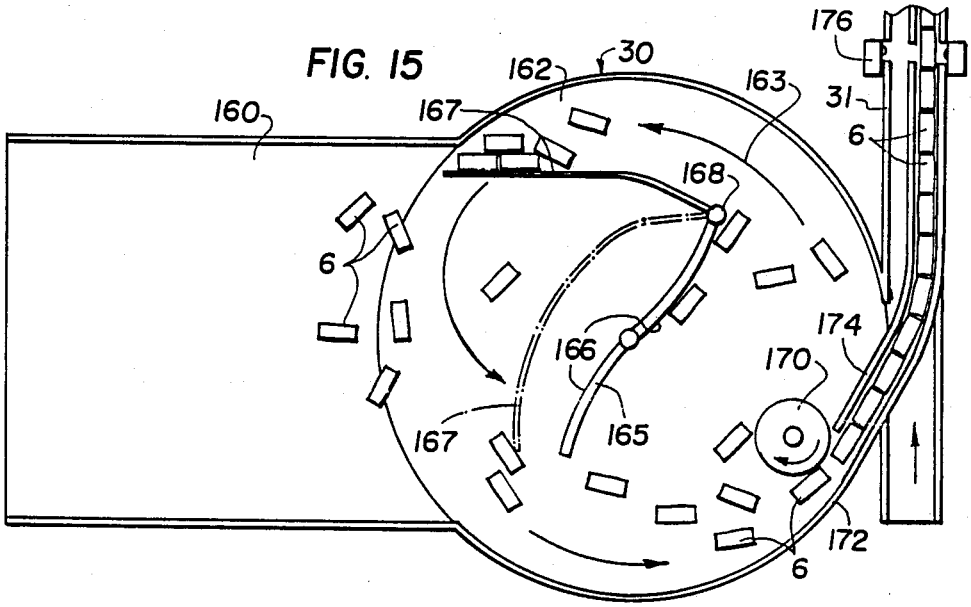
FIG. 15 is a top plan view of a component conveyor for conveying components in an orderly fashion to the component loading device.

FIG. 15 illustrates details of the tray conveyor 30. The tray conveyor 30 serves both to supply trays to feed the tray conveyor 31 and also as a magazine to store a supply of trays.

Trays are manually deposited in a right side up position onto a fixed table 160 and are pushed toward a turntable 162 which rotates in the direction of arrow 163. Trays are thus taken up and moved in a circular path on turntable 162.

A curved rigid wall 165 is provided near the center and slightly above the turntable 162. Wall 165 has curved surfaces 166 which face in an upstream direction with respect to arrow 163, so that any tray striking against that surface will tend to move radially outwardly and out into the main stream of trays, which are generally confined to an area near the outer periphery of turntable 162. To further facilitate movement of the trays out into this peripheral area, a spring wall 167 is provided. The spring wall 167 is made of weak spring material and is anchored at one end by a post 168. Post 168 is suspended from above and is spaced above the turntable 162. When trays accumulate behind the spring walls 167, that is above the wall as shown in FIG. 15, they tend to urge the spring into its phantom line position. The spring is selected to have a tension which is so weak that the trays can force their way pass the spring, rather than being discharged back onto fixed table 60.

Along the path of turntable 162, a counter rotating friction wheel 170 is provided for rotation in a direction opposite to turntable 162. Trays which engage the outer periphery of friction wheel 70 are urged back into the main stream on the turntable 162. If, however, a tray finds itself at the extreme outer periphery of the turntable, and between an outer fence 172, around the outside of the turntable, and an inner fence 174 immediately downstream of the friction wheel, that tray will be guided into a path between these fences and onto the conveyor 31.

As with the other operating stations of the invention, a sensor 176 ensures that there is an ample supply of trays on conveyor 31. Returning to FIG. 13, a sensor 55 is provided immediately adjacent the side 125 of guideway 25 to ensure that a tray is available for being loaded onto the compact. Another sensor 157 senses that there is a tray waiting for a subsequent loading operation. If any of sensors 155, 157 or 176 indicate the absence of a tray, a warning signal is issued by the computer to stop the manufacturing process until a sufficient supply of trays has been re-established.

In addition, at locations downstream of the component loading stations, on the guideway, shown in FIG. 13, additional sensors (not shown) are provided to ensure that each compartment for an acceptable compact has been filled with a tray. Again, if any tray is missing, the corresponding compact will be labeled as unacceptable for all future operations and will ultimately be discharged onto the unacceptable article pathway.

Figure 17:
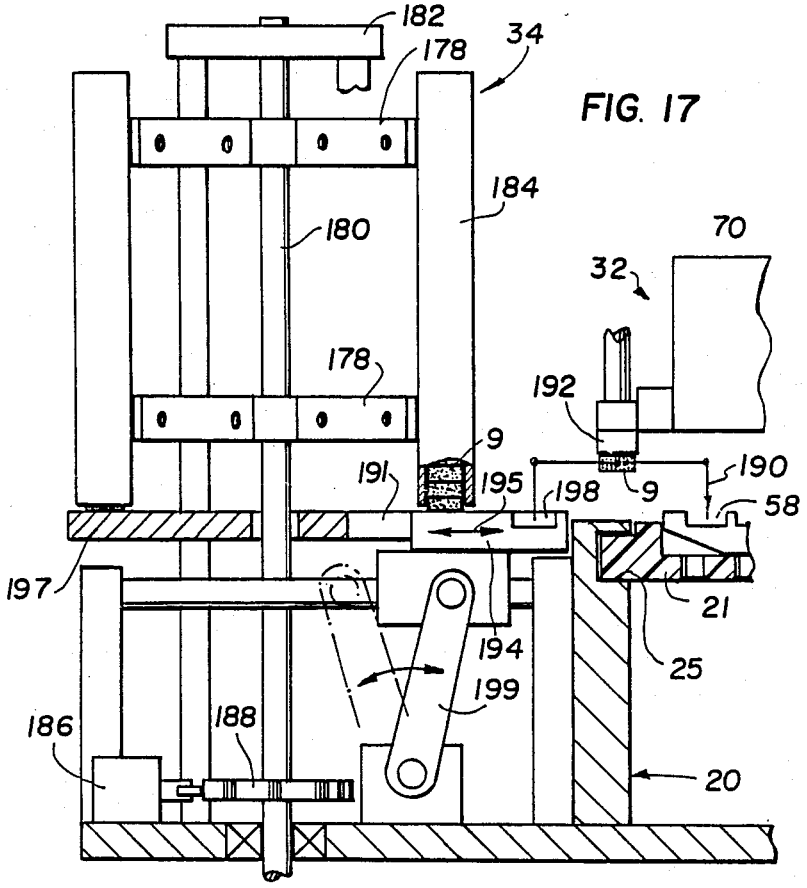
FIG. 17 is a side sectional view of FIG. 16.
Figure 18:
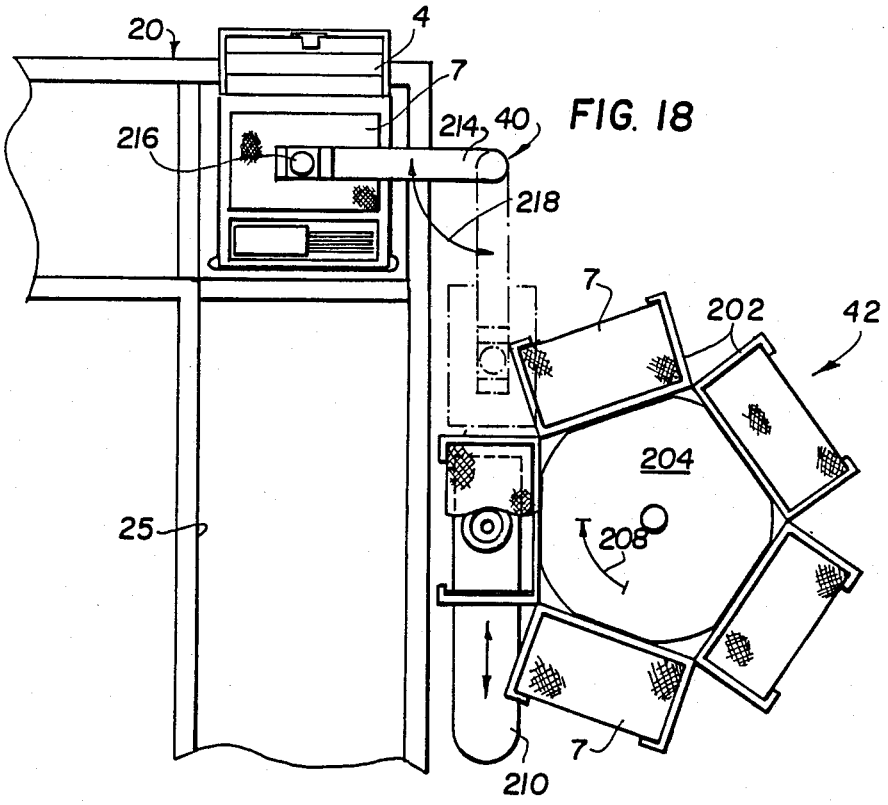
FIG. 18 is a top plan view of a dust cover magazine and loading device for loading dust covers onto articles being manufactured.

FIGS. 17 and 18 illustrate details of the brush loading device 32 and the brush magazine 34.

The brush magazine comprises a turret having a plurality of vertically spaced turret plates 178 which are fixed to a turret shaft 180 that is rotatably mounted on a rigid support column 182. Shaft 180 is rotated by any suitable means (not shown) for indexing each one-sixth of the turn. Indexing is achieved by a switch 186 connected to the drive for shaft 180 for stopping the drive. A cam 188 has six projections and is provided for this purpose.

The six positions correspond to six magazine columns 184 which each carry a vertical stack of brushes 9. One of the columns 184 is brought over a reciprocating plate 194 which has a flat planar surface 196 and a recess 198.

Plate 194 is reciprocated in the direction of arrow 195 by a crank 199 pivotally connected to the chassis 20. With plate 194 in the solid line position, shown in FIG. 16, the lowermost brush 9 drops into recess 198, which is large enough to receive the brush. Crank 199 then pivots in a clockwise direction to slide plate 194 toward the guideway 25. In this position, as shown at FIG. 17, an arm 70 of the brush loading device 32 is activated to move in a path 190. A suction head 192 on arm 70 is then activated to suctionally attract brush 9 and to carry it from recess 198 into the indentation 58 of compact 4. A valve is then closed to stop the flow of vacuum from suction head 192 to release the brush in the indentation 58. Downstream of this brush loading station, a sensor shown, for example, at 175, in FIG. 16, senses that, in fact, the loading operation was successful. If not, this article is labeled as unacceptable. As shown in FIG. 1, loading device 32 is powered by a shaft 37 which can be rotated by a pulley and belt arrangement engaged with the main shaft 23. Arm 70 can also be provided with a second suction head 193 for loading applicators 8 from an applicator conveyor 36 into the indentation 58. This is an alternative operation for articles meant to receive an applicator rather than a brush.

Figure 16:
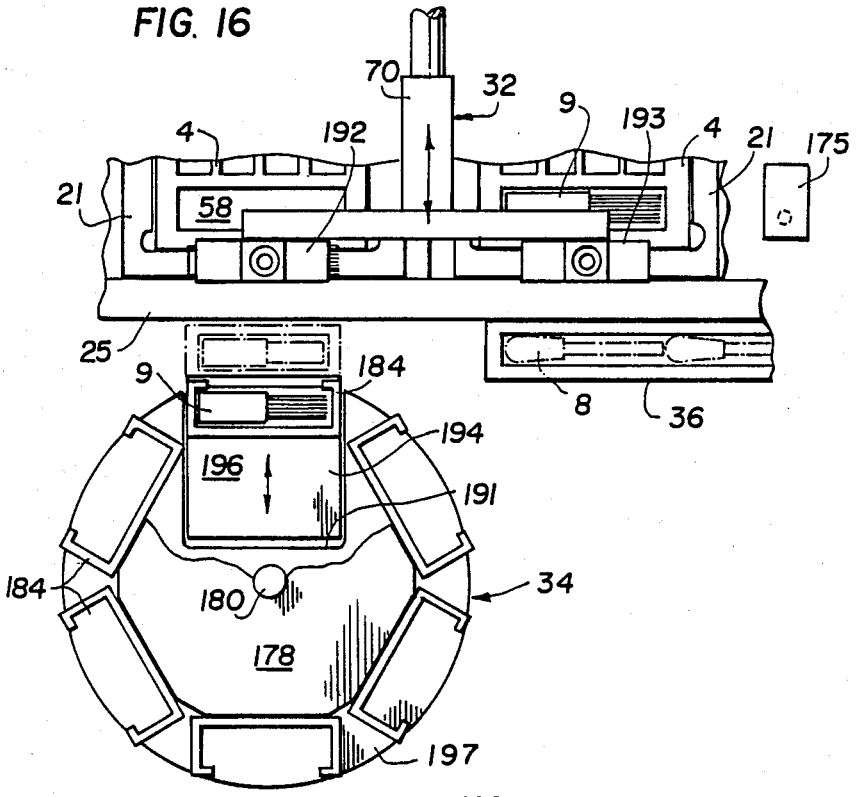
FIG. 16 is a top plan view, with portions cut away, of a brush magazine and a device for loading a brush or applicator onto an article being manufactured.

It is noted that as shown in FIGS. 16 and 17, the flat surface 196 is in a position with respect to the recess 198, so that all remaining brushes are retained in the downwardly open magazine column 184, while one of the brushes is being loaded. The brushes in the other columns are retained on the upper surface of a retaining plate 197, which is co-planar with the surface 196. Slide plate 194 moves in a recess 191 of plate 197.

Suitable sensors or a manual operation can be utilized to determine when all brushes of one column have been used up. At this point, the magazine is indexed by one-sixth of a turn to bring the new column over plate 194 and into a loading position. The control logic for this indexing function ensures that the slide plate 194 is in the position shown in FIG. 17, however, to make sure that a new column of brushes is brought over the flat surface 196 of the plate.

Figure 19:
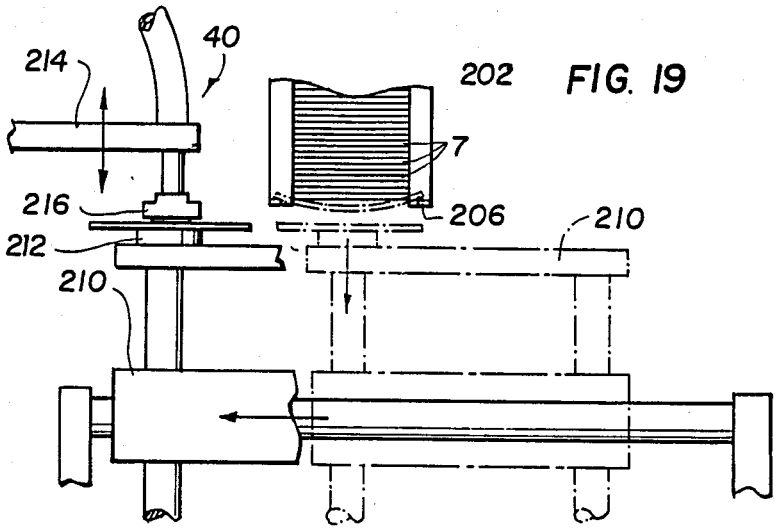
FIG. 19 is a fragmentary side elevational view of FIG. 18.

FIGS. 18 and 19 show the dust cover magazine 42 and loading device 40. Magazine 42 comprises a turret structure substantially the same as the turret structure for the brush magazine 34. Since the dust covers are larger than the brushes, only five magazine columns can be provided around a turret plate 204. Unlike the magazine columns of the brush magazine, columns 202 have lower ledges 206 at the opposite sides of an otherwise open bottom to the column 202. This gently supports the column of relatively light and flexible dust covers 7 in each magazine column.

The column can be indexed by one-fifth of a turn in the direction of arrow 208 to bring a fresh column into registry above a loading slide 210. Loading slide 210 carries a suction head to 212 and is reciprocated by an X-Y actuator (not shown). As shown in FIG. 19, the slide 210 is first brought to a position with suction head 112 immediately below the lowermost dust cover 7 in column 202. Suction is applied to the suction head to suctionally embrace the lowermost dust cover. Slide 210 is then moved downwardly. This causes the dust cover to bend slightly with its outer edges disengaging from the ledges 206. The slide 210 is then brought to the left as shown in FIG. 19 below the dust cover loading device 40. The dust cover loading device comprises a swing arm 214 and a suction head 216. Suction is stopped for suction head 212 and initiated for suction head 216 to transfer the pad from slide 210 to swing arm 214. Swing arm 214 then moves upwardly and swings in a clockwise direction as shown in FIG. 18, along curve path 218, to bring the dust cover 7 over the trays in the compact 4. Suction is then discontinued for suction head 216 to release the path.

Swing arm 214 can be moved both axially and rotationally by the actuator disclosed in U.S. Pat. No. 3,869,924.

As with the other loading and operating stations of the invention, sensors are provided to ensure that a pad has been successfully deposited onto the compact. Otherwise, the compact is categorized by the computer as being unacceptable.

Referring now to FIGS. 20 and 21, the lid closing device 44 comprises a pair of slide shafts 220 which are mounted for sliding in a bearing 222 that is fixed to the chassis 20. Adjacent ends on one side of the shafts 220 are connected to each other by an engagement plate 224. A spring 226 is engaged between plate 224 and bearing 222 to urge shafts 220 to the right as viewed in FIG. 20. This movement is only permitted, however, by movement of a crank 228, which is pivotally connected to the chassis 20 for reciprocal movement in the direction of arrow 230. Crank 228 can be driven by the main shaft of the chassis, or by any other suitable means. The adjacent opposite ends of shafts 220 are connected to a forkplate 232 which carries a pair of lower rollers 234 and a pair of upper rollers 236. As shown in FIG. 21, forkplate 232 has an opening large enough to admit an open lid 55 of the compact or article 4. The rollers, however, are positioned to engage the lid.

By rotating crank 228 in a clockwise direction, forkplate 232 is moved from its solid line position, shown in FIG. 20 to its phantom line position by spring 226. At the start of this movement, the upper rollers 236 engage the upper end of open lid 55 to begin rotating the lid in a closing direction along a path 228. At an intermediate position in the movement of forkplate 232, the lower rollers 234 then engage the top of the almost completely closed lid. The lower rollers 234 are positioned so that they exert a small downward pressure on the lid to force the latch projection of the lid into the latch recess of the base for the compact 4.

The movement of forkplate 232 in a direction to close the lid is produced by the bias of spring 226. If the rollers or the forkplate engage an immovable structure, for example, a jammed lid, this avoids damage to the chassis or additional damage to the article, since movement of the forkplate will stop when this obstructing force exceeds the force of the spring 226. The forkplate is then retracted to its forward solid line position, shown in FIG. 20, by movement of the crank 228 in the counter clockwise direction.

As with the other operations of the invention, sensors are provided downstream of this lid closing station to ensure that the lid has been successfully closed.

Figure 22:
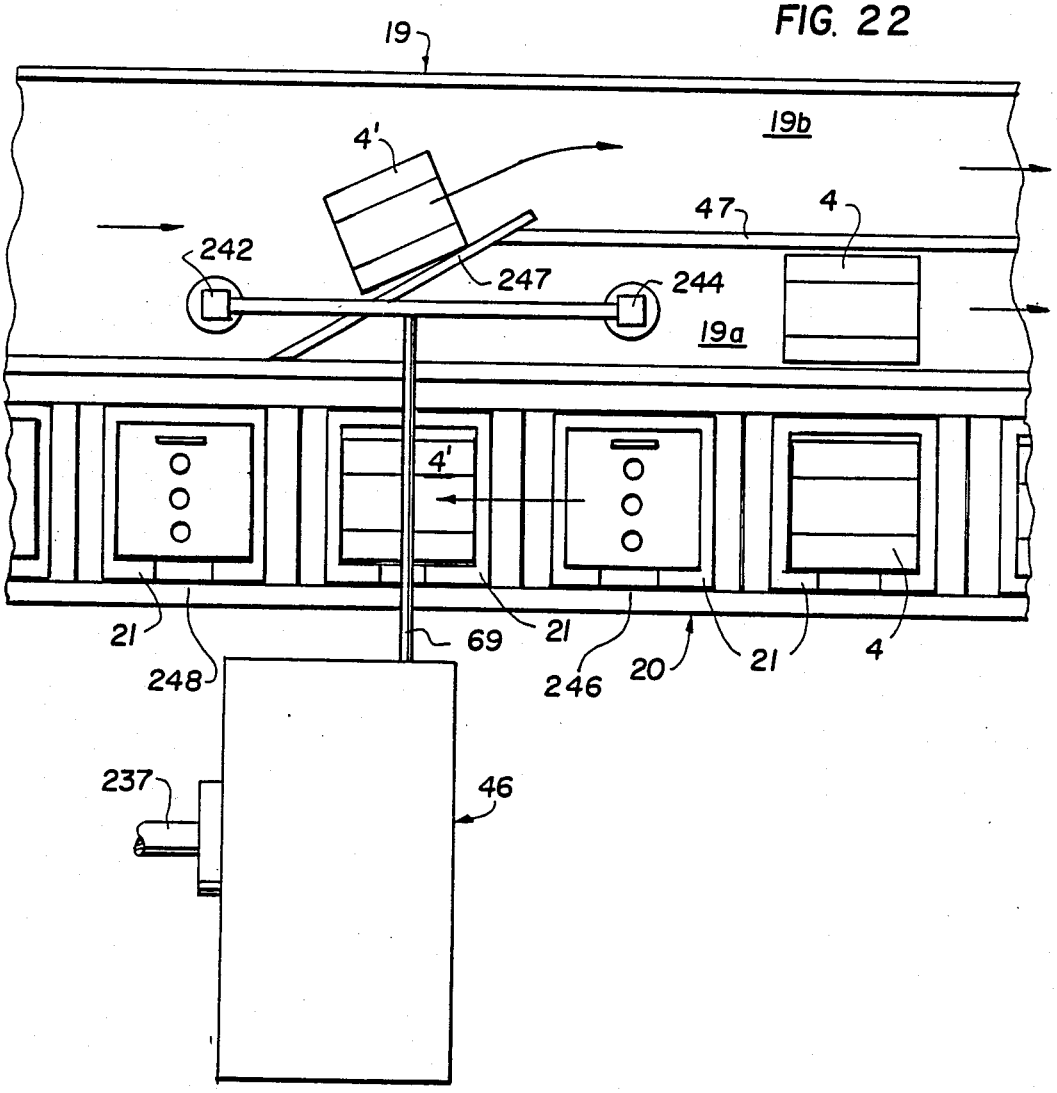
FIG. 22 is a top plan view of an article unloading device for unloading acceptable articles onto an acceptable article pathway and for unloading unacceptable articles onto a separate unacceptable article path to separate acceptable and unacceptable articles from each other.

FIG. 22 shows details of the unloading device 46. This device has an arm 69 which can move in an X-Y plane. Device 46, can be formed, for example, by the actuator of U.S. Pat. No. 3,881,362. It is driven by a shaft 237 which can be rotated by a pulley arrangement from the main shaft 23.

Arm 69 carries a pair of suction heads 242 and 244.

When a puck 21 containing an acceptable article is brought to an acceptable article unloading station 246, on the chassis 20, suction is provided for the head 244 and arm 69 is moved through its unloading cycle to first descend on the article at station 246, to then lift that article, to then move the article out over the acceptable article pathway 19*a*, and then to lower the article onto the pathway and discontinue the suction.

For an unacceptable article at station 246, no vacuum is provided to suction head 244 so that the arm executes a cycle, but does not actually unload the article. This article remains on its puck until reaching an unacceptable article unloading station 248. At this location, suction is provided to the other suction head 242 and arm 69 is moved through its unloading cycle to discharge the unacceptable article, shown at 4', onto the unacceptable pathway 19*b*. To allow use of a single conveyor 19 for both pathways, conveyor 19 is separated a its downstream end by the rail 47. At the upstream end of this rail, a diverting rail 247 is provided which extends at an angle to the direction of movement of conveyor 19 to deflect the unacceptable article 4' into the unacceptable article pathway 19*b*.

Acceptable articles discharged from path 19*a* are then subjected to subsequent operations, such as shrink wrapping, packaging into boxes and assembling into larger containers for shipping.

Unacceptable articles from pathway 19*b* are packaged in bulk, either for re-use of components or recycling of materials.

While a specific embodiment of the invention has been showed and described in detail to illustrate the application of the principles of the invention, it will be understood that the invention may be embodied otherwise without departing from such principles.

The invention claimed is:

1. An apparatus for assembling a multi-part article, having a base with at least one receptacle for receiving a component, and a lid hinged to the base for movement from a closed position, covering the receptacle to an open position exposing the receptacle, the apparatus comprising:

an assembly chassis having an endless guideway;

a plurality of pucks mounted for movement on said guideway to a plurality of accurately located stations in sequence around said guideway, each puck having a site for receiving the base of an article to be assembled;

puck drive means for indexing each puck from one station to the next around said guideway;

article loading means for loading an article into the site of each puck on said guideway at an article loading station along said guideway;

lid opening means for opening the lid of each article at an opening station along said guideway;

component loading means for loading a component into the receptacle of each article at a component loading station along said guideway;

lid closing means for closing the lid of each article at a lid closing station along said guideway;

sensing means adjacent said guideway, at a location along said guideway between said opening station and an article unloading station, for sensing the readiness of each article, for successfully receiving a component;

computing means connected to said sensing means for keeping track of each puck as it moves from station to station along said guideway, said computing means being connected to said sensing means for determining whether each article is ready to receive a component or not, and, upon receiving a signal from said sensing means indicating that an article is not ready to receive a component, identifying the puck carrying that article as containing an unacceptable article; and article unloading means at said article unloading station along said guideway, for unloading unacceptable articles onto an unacceptable article pathway and all remaining articles onto an acceptable article pathway, said computing means being connected to said article unloading means for controlling said article unloading means to unload articles from pucks identified as carrying unacceptable articles onto said unacceptable pathway, and all remaining articles onto said acceptable article pathway when the pucks carrying said articles reach said article unloading station.

2. An apparatus according to claim 1, wherein said sensing means is located upstream of said component loading means, said computing means being connected to said component loading means for suppressing said component loading means when a puck identified as carrying an article that is unacceptable by said computer, reaches said component loading station, whereby the loading of components into unacceptable articles is avoided.

3. An apparatus according to claim 2, including glue depositing means at a gluing station along said guideway, downstream from said opening station and upstream from said component loading station, said glue depositing means depositing glue into each receptacle of each article when a puck containing each article reaches said gluing station, said sensing means being adjacent said gluing station for sensing whether glue has been successfully deposited into each receptacle, and upon sensing the failure of a deposit of glue into a receptacle, sending a signal to said computing means, identifying the puck containing the article at said gluing station as being unacceptable.

4. An apparatus according to claim 2, wherein said sensing means is adjacent said opening station for verifying the opening of the lid for each article by said lid opening means, and upon sensing the failure of an article lid to be opened, sending a signal to said computing means identifying the puck carrying the article at said opening station as being unacceptable.

5. An apparatus according to claim 1, including article transport means for bringing a plurality of articles to said chassis, said article transport means comprising a first conveyor for transporting articles in a lid side down condition, labeling means for labeling the base of each article, article flip over means at a discharge end of said first conveyor for flipping each article from a lid side down condition to a lid side up condition, and a second conveyor having an input end for receiving lid side up articles from said flip over means, said second conveyor conveying articles to said article loading means.

6. An apparatus according to claim 5, wherein said flip over means comprises an actuator having a rotary arm, with an engagement head for engaging one side of each article at the discharge end of said first conveyor, and for rotating each article onto said input end of said second conveyor.

7. An apparatus according to claim 1, wherein the base of each article includes an indentation for receiving an applicator, said apparatus including applicator loading means at an applicator loading station along said guideway for loading an applicator into the indentation of each article, and an applicator magazine for containing a supply of applicators and for supplying applicators, one at a time, to said applicator loading means.

8. An apparatus according to claim 1, including dust cover loading means at a dust cover loading station along said guideway, downstream of said component loading station, for loading a dust cover over the component of each article, and a a dust cover magazine for supplying dust covers, one at a time, to said dust cover loading means.

9. An apparatus according to claim 1, including a discharge conveyor for receiving all articles from said article unloading means, a dividing rail extending along said discharge conveyor for dividing said discharge conveyor into said acceptable article pathway on one side of said dividing rail, and said unacceptable article pathway on the opposite side of said dividing rail, a diverting rail at an upstream end of said dividing rail in a direction of movement of said discharge conveyor, for diverting articles unloaded by said article unloading means upstream of said diverting rail into one of said pathways, said article unloading station comprising a first station location upstream of said diverting rail and a second station location downstream of said diverting rail, said article unloading means comprising an actuator carrying an arm having two article engagement heads, one engagement head being positioned on said arm for movement between said first station location, and a location on said discharge conveyor upstream of said diverting rail, and the other of said engagement heads being positioned on said arm for movement between said second station location, and a location on said discharge conveyor downstream of said diverting rail.

10. An apparatus according to claim 9, including article transport means for bringing a plurality of articles to said chassis, said article transport means comprising a first conveyor for transporting articles in a lid side down condition, labeling means for labeling the base of each article, article flip over means at a discharge end of said first conveyor for flipping each article from a lid side down condition to a lid side up condition, and a second conveyor having an input end for receiving lid side up articles from said flip over means, said second conveyor conveying articles to said article loading means, said second conveyor comprising said discharge conveyor, said article loading and unloading means being located at an intermediate location along said discharge conveyor.

11. An apparatus according to claim 10, including an article stop located over said discharge conveyor at a location on said discharge conveyor, upstream of said diverting rail for stopping the movement of articles at a location adjacent said article loading station.

12. An apparatus according to claim 1, wherein said computing means comprises a computer having a shift register with a plurality of address locations, each corresponding to one of said pucks, said address locations shifting along said shift register as said pucks move from station to station along said guideway, each address location containing data indicative of the acceptable or unacceptable condition of the article in each puck.

13. An apparatus according to claim 5, wherein said transport means includes an infeed conveyor for movement substantially perpendicular to said first conveyor, a dead plate mounted for movement at a discharge end of said infeed conveyor over an input end of said first conveyor, an actuator for moving said dead plate parallel to the movement of said infeed conveyor, articles deposited on said infeed conveyor being moved by said infeed conveyor against said dead plate to form a row of articles along said dead plate, said dead plate being moveable to deposit the row of articles onto the input end of said first conveyor.

14. An apparatus according to claim 6, including a pair of spaced apart parallel rails on said first conveyor defining a pathway there-between for a row of articles, each rail having an extension extending beyond a discharge end of said first conveyor with a stop on each extension, at least one article being moveable by said first conveyor into a position spanning said extensions, said engagement head being moveable by said rotary arm from below and between said extensions for engaging and lifting an article from between said extensions onto the input end of said second conveyor.

15. An apparatus according to claim 1, including further sensing means downstream of said article loading station on said guideway for sensing the presence of an article in each puck at a location downstream of said article loading station, said further sensing means being connected to said computing means for identifying each puck which does not carry an article for suspending subsequent operations on articles for that puck.

16. An apparatus according to claim 1, wherein the article base and lid both include a step and both include a latch member for engagement to latch the lid in its closed position to the base, said lid opening means comprising a first slide for movement toward and away from a puck at said opening station, a hold down finger connected to said first slide for engagement over the step of the base of an article in the site of the puck at said opening station, an unlatching finger mounted for vertical movement to said first slide, said unlatching finger being engagable under the sep of the lid for an article in the puck at said opening station when said hold down finger is engaged over the step of the base of that article, finger raising means engagable with said unlatching finger to raise said unlatching finger to unlatch the latch member of the lid from the latch member of the base, a second slide mounted for sliding toward and away from said opening station, and at least one opening finger connected to said second slide for movement between the base and the lid of an article in the puck at said opening station for moving the lid into the open position.

17. An apparatus according to claim 16, wherein said first and second slides are mounted for movement parallel to each other and transversely to the direction of movement of pucks along said guideway.

18. An apparatus according to claim 16, wherein said finger raising means comprises a vertically extending rod for movement into engagement with a lower surface of said unlatching finger to raise said unlatching finger, and a spring engaged between said first slide and said unlatching finger for urging said unlatching finger downwardly toward said hold down finger, said hold down and unlatching fingers extending substantially parallel to each other.

19. An apparatus according to claim 16, including a support connected to said assembly chassis and carrying said first slide for movement toward and away from said opening station, and a spring engaged between said support and said first slide for urging first slide toward said opening station, said lid opening means including a first slide driver comprising a crank pivotally mounted to said chassis for moving said first slide away from said opening station against the bias of said spring, while permitting movement of said first slide by virtue of the bias of said spring toward said opening station.

20. An apparatus according to claim 1, wherein said component loading means comprises a component supply conveyor for carrying and circulating a supply of components to be loaded, a component feeding conveyor for feeding a row of components from said component supply conveyor to a location adjacent said component loading station on said guideway, and an actuator for depositing one component at a time from said component feeding conveyor into the receptacle of an article on a puck at said component loading station.

21. An apparatus according to claim 20, wherein said component supply conveyor comprises a fixed table for receiving a supply of components, a rotatable turntable having an outer periphery in communication with said fixed table for receiving components from said fixed table onto said periphery of said turntable, a flexible spring wall extending tangentially over the periphery of said turntable, said spring wall having one end fixed at a location spaced away from said fixed table and an opposite end moveable by virtue of components engaging against said spring wall in a path adjacent said fixed table, said spring wall having a selected degree of flexibility, whereby an accumulation of components being moved by said turntable against said spring wall tends to bend said spring wall, said components remaining on the periphery of said turntable and moving past said bent spring wall with rotation of said turntable.

22. An apparatus according to claim 21, including a rigid wall extending radially at a fixed location near the center of said turntable and above said turntable, said rigid wall having upstream surfaces that are curved convexly in a direction facing upstream of the direction of rotation of said turntable.

23. An apparatus according to claim 21, including a friction wheel mounted at a peripheral location over said turntable which is spaced away from said fixed table, said friction wheel rotating in a direction opposite to the direction of rotation of said turntable and having an outer periphery spaced inwardly from an outer edge of said turntable to define a pathway for components, an outer fence engaged around said turntable for retaining components on said turntable, and an inner fence spaced inwardly of said outer fence and defining an inlet pathway for components which extends onto said component feeding conveyor.

24. An apparatus according to claim 21, including a pivot stop at a discharge end of said component feeding conveyor which is adjacent said guideway for retaining a row of components upstream of said pivot stop on said component feeding conveyor, and drive means connected to said pivot stop for momentarily pivoting said pivot stop to permit movement of one upstream most component of the row of components on said component feeding conveyor toward said guideway for engagement by said actuator, said pivot stop being pivoted by said drive means back for stopping movement of all other components on said component feeding conveyor.

25. An apparatus according to claim 7, wherein said applicator magazine comprises a turret carrying a plurality of vertically extending downwardly open magazine columns, each for carrying a vertical stack of applicators, a retaining plate below the open end of said magazine columns, having an upper surface for retaining all applicators in their columns, said retaining plate having a recess therein, adjacent said guideway, a reciprocating plate in said recess having an upper surface parallel to the upper surface of said retaining plate and mounted for movement toward and away from said guideway, said reciprocating plate having a recess therein shaped to receive a single applicator from a lower open end of one magazine column positioned above said recess, said reciprocating plate reciprocating to engage one applicator from the lower end of one column and to move the applicator into a location next to the guideway for engagement of the applicator by said applicator loading means, and indexing means connected to said turret for indexing said turret to bring each magazine column into registry above said recess, one at a time.

26. An apparatus according to claim 25, wherein said applicator loading means comprises an actuator having an arm with an applicator engagement head for movement into engagement with an applicator in the recess of said reciprocating plate, into the indentation of an article on a puck in the applicator loading station.

27. An apparatus according to claim 8, wherein said dust cover magazine comprises a turret carrying a plurality of magazine columns, each for containing a column of dust covers, each column having an open lower end flanked by ledges for supporting outer edges of a lowermost dust cover in each magazine column, a slide having an engagement head for engaging a lower surface of a lowermost dust cover in a column of the turret which is adjacent the guideway, said slide being moveable downwardly to discharge a dust cover from the lower end of the magazine column, said slide being mounted for movement away from the magazine column, said dust cover loading means comprising an actuator having an arm mounted for rotation about an axis and for axial movement along said axis, said arm having an engagement head moveable toward the engagement head of said slide for transferring engagement of a dust cover from the engagement head of slide to the engagement head of said arm, said actuator rotating said arm over an article in a puck at a dust cover loading station on said guideway for depositing a dust cover onto the article.

28. An apparatus according to claim 1, wherein said lid closing means comprises a fork mounted for movement over said closing station of said guideway, means for reciprocating said fork over said closing station of said guideway, and a plurality of rollers rotatably mounted to said fork and engagable with an open lid of an article in a puck at said closing station for closing said lid with movement of said fork.

29. An apparatus according to claim 28, including a first pair of upper rollers connected to said fork and a second pair of lower rollers connected to said fork, said upper rollers being mounted for rotation to said fork at a location for first engaging an open lid of an article in a puck at said closing station.

* * * * *